US010770048B2

(12) United States Patent
Murr

(10) Patent No.: US 10,770,048 B2
(45) Date of Patent: Sep. 8, 2020

(54) ANALOG SYNTHESIZER PATCH MORPHING AND SIMULTANEOUS PARAMETER CONTROL THOUGH INPUT DEVICES

(71) Applicant: LAFAYETTE COLLEGE

(72) Inventor: Calvin F. Murr, Easton, PA (US)

(73) Assignee: Lafayette College, Easton, PA (US)

( * ) Notice: Subject to any disclaimer, the term of this patent is extended or adjusted under 35 U.S.C. 154(b) by 144 days.

(21) Appl. No.: 15/979,168

(22) Filed: May 14, 2018

(65) Prior Publication Data

US 2018/0330704 A1 Nov. 15, 2018

Related U.S. Application Data

(60) Provisional application No. 62/505,563, filed on May 12, 2017.

(51) Int. Cl.

| | |
|---|---|
| ***G10H 1/34*** | (2006.01) |
| ***G10H 1/00*** | (2006.01) |
| ***G10H 1/055*** | (2006.01) |

(52) U.S. Cl.

CPC ..... *G10H 1/34* (2013.01); *G10H 1/0008* (2013.01); *G10H 1/0558* (2013.01); *G10H 2210/305* (2013.01); *G10H 2220/315* (2013.01)

(58) Field of Classification Search

CPC ..... G10H 1/34; G10H 1/0008; G10H 1/0558; G10H 2210/305; G10H 2220/315

USPC ..... 84/719

See application file for complete search history.

(56) References Cited

U.S. PATENT DOCUMENTS

| | | | | |
|---|---|---|---|---|
| 4,478,124 | A * | 10/1984 | Kikumoto | G10H 7/08 84/602 |
| 4,953,437 | A * | 9/1990 | Starkey | G10H 1/057 84/603 |
| 4,998,960 | A * | 3/1991 | Rose | G10H 1/0008 84/602 |
| 5,862,063 | A * | 1/1999 | Thome | G10H 7/002 708/290 |
| 5,890,115 | A * | 3/1999 | Cole | G10H 7/02 704/258 |
| 10,418,013 | B2 * | 9/2019 | McKenna | G10H 7/10 |
| 2001/0003943 | A1 * | 6/2001 | Matsuda | G10H 7/02 84/615 |
| 2004/0144241 | A1 * | 7/2004 | Juskiewicz | G10H 1/0058 84/723 |

(Continued)

*Primary Examiner* — David S Warren
*Assistant Examiner* — Christina M Schreiber
(74) *Attorney, Agent, or Firm* — Vos-IP, LLC

(57) ABSTRACT

A sound generating analog synthesizer comprising a controller electronically connected to rotate at least one knob, actuate at least one switch, and make at least one patch connection; said knob comprising a drive system, a shaft position sensor, and a potentiometer; wherein said controller rotates at least one knob by generating instructions to said drive system; said at least one switch comprising an electronic connection to said controller to turn on or off said switch upon receiving instructions from said controller; and at least one patch connection, comprising at least one patch switch, wherein said at least one patch switch controls connection between at least one input of said patch and at least one output of said patch; and a control system to interpolate the potentiometer, switch and patch connections between at least two predetermined settings.

20 Claims, 4 Drawing Sheets

(56) References Cited

U.S. PATENT DOCUMENTS

| | | | | |
|---|---|---|---|---|
| 2004/0206226 | A1* | 10/2004 | Negoescu | G10H 7/006 84/600 |
| 2007/0000374 | A1* | 1/2007 | Clark | G10H 1/0008 84/724 |
| 2009/0064850 | A1* | 3/2009 | Lengeling | G10H 1/34 84/634 |
| 2013/0087037 | A1* | 4/2013 | Dreher | G10H 1/0066 84/645 |
| 2013/0239787 | A1* | 9/2013 | McMillen | G10H 1/0008 84/643 |
| 2018/0330704 | A1* | 11/2018 | Murr | G10H 1/34 |
| 2018/0330708 | A1* | 11/2018 | McKenna | G10H 5/002 |
| 2019/0385580 | A1* | 12/2019 | McKenna | G10H 7/02 |

* cited by examiner

ANALOG SYNTHESIZER PATCH MORPHING AND SIMULTANEOUS PARAMETER CONTROL THOUGH INPUT DEVICES

PRIORITY CLAIM

This application claims priority to U.S. Provisional Patent Application No. 62/505,563 filed May 12, 2017, which is hereby incorporated by reference in its entirety.

FIELD OF INVENTION

The present application is related to an analog synthesizer device that includes automated electrical and mechanical components to allow for the generation of sound that "smoothly" moves between a set of pre-defined sounds so that multiple parameters can be changed simultaneously and repeatedly.

BACKGROUND OF INVENTION

Analog synthesizers commonly use a wheel or pedal to change a user single input while playing the device (e.g. oscillator frequency or filter cut-off frequency). Wheels and pedals are currently limited to control the inputs adjusted with knobs. Furthermore, the connections made by patch cables are binary and cannot be proportionally controlled between fully off and fully on.

Current analog synthesizer techniques have limited capability to allow the user to be guided to create a previous sound. Furthermore, it is difficult for the user to accurately document and reproduce same sound due to the complexity of the device.

Currently the process to recall a sound is semi-digital where the knob position does not directly control a voltage used by a synthesizer module. These are called "infinite knobs" and the physical position does not correlate to an absolute setting for any given parameter of the synthesizer. To see the value of the setting the user must look at a numeric display. This makes it difficult to "play" as an instrument.

Currently there is no analog synthesizer that can store the patch connections between modules as they are made by manually plugging cables into sockets on the modules.

Current wave form generating techniques typically use "modules", such as oscillators, envelope generators, arbitrary waveform generators, digital pattern generators and frequency generators are limited by the current method which involves a technical understanding the underlying circuits within a module as well as different ways to connect or electrically "patch" modules together.

By contrast, once digital synthesizers came into fashion, they can modify some of these features through non-analog sound formation. Indeed, certain digital synthesizers use inputs, such as joysticks or touch sensitive pads that can provide the ability to control more than one input at a time.

Digital Audio Workstation software has the ability to control every parameter of a digitally simulated synthesizer, however the interface requires the inputs be determined in advance of paying the sound. The interface is analogous to musical notation and does not allow the user to "play" the sounds in real time.

SUMMARY OF INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The present invention is drawn to a method to produce a sound a user creates using on an analog synthesizer, for example the device for the application is selected from, but not limited to a joystick or pressure sensitive pad.

The user input device allows the user to define a relationship between previously generated synthesizer settings that are selected by the user. An input device allows the user to express a sound generated by any one of those saved settings as well as a combination of the known settings.

In one embodiment, the position of a joystick would be linearly related to the settings of the synthesizer assigned to the top, left, right and bottom extrema of the joystick's travel, namely the X, Y coordinate path of movement for the joystick.

The user input device would be capable of physically controlling all of the synthesizer inputs including knob positions, switch positions and patch connections.

One implementation of the invention would be for a user to use a keyboard to adjust the frequency of a sound, as is commonly done, while the user input device could be used to simultaneously adjust the settings for both the module that the keyboard is controlling, as well as modules which modify the output of the keyboard controlled module.

In a further embodiment, the present innovation describes a method to control analog synthesizer with an interface that allows all settings to be adjusted between specified settings. The interface device can be, but is not limited to a joystick or touch sensitive pad. The interface device allows the user to control all of the analog synthesizer settings in real-time.

The present innovation further describes a method to allow the patch connections to be made with electronic circuits, instead of manually. Furthermore, the patch connections can bet set to be any proportion of fully-on and fully-off so that as the interface device input changes, the synthesizer "smoothly" adjusts all of the settings to change the sound continuously without binary adjustments in the setting.

The present innovation can further utilize any method available to automatically control the inputs to the synthesizer that are controlled by knobs or switches.

In a further embodiment, the present invention would be capable of controlling knob settings of any analog synthesizer without any alterations to the synthesizer itself. This would be achieved through a knob and remote motorized actuator pair. The "knob" would be within reach of the user, and when the user makes any changes to a particular knob, that change would be remotely actuated on the corresponding knob on the synthesizer itself.

In a further embodiment, the present invention would be able to identify the analog synthesizer module which the user wishes plugs into the invention, so that the invention allocates the number of knobs and patch inputs and outputs and would be able to display the dynamic characteristics of that module in real time.

In a further embodiment, the display contained within the current invention would, through the plotting of mathematical transformations, represent the effect of a given module on a synthesizer as a whole, and thus user inputs to that module, in real time. This display would alter adapt in real time when new modules are swapped in our out of the present invention.

A further embodiment is directed towards a user input device for an analog synthesizer, comprising at least one knob, comprising at least two predetermined settings for the position of at least one knob, at least one connection between said input device and an analog synthesizer, wherein the connection allows for controlled manipulation of the at least one knob interpolated between the at least two predetermined settings. In certain embodiments, wherein said user device comprises a plurality of knobs, and wherein the at least two predetermined settings control the plurality of knobs, and wherein the connection allows for interpolation between the at least two predetermined settings. Certain embodiments further comprising at least one switch and wherein the connection allows for controlled manipulation of both the at least one knob and the at least one switch simultaneously. Certain embodiments further comprise wherein the user device includes the capability to adjust synthesizer knob positions and switch positions automatically between two or more predetermined positions.

A system for manipulating a plurality of knobs on an analog synthesizer comprising an input device, an electronically controlled analog synthesizer having each of the plurality of knobs having independent control via an electronic mechanism; a computer implemented program capable of simultaneously controlling the plurality of knobs; wherein application of a modification on said input device causes simultaneous modification of the plurality of knobs. The system in certain embodiments further comprises a plurality of switches, electronically controlled on said analog synthesizer and having independent control via said computer implemented program.

In certain embodiments, the devices and systems of the present embodiments provide the capability to change the path connections of a switch by proportionally varying the connections between fully-on and fully-off.

In the embodiments, the computer implemented program can store and save to memory the settings associated with a particular sound allows the recorded states to be used to define the "sound space" that the user can move through using the input device. These components, devices, and systems can be implemented as a semi-modular synthesizer.

The devices and systems of the embodiments can comprise a retro-fit system, comprising the necessary switches, motors, and controls, suitable for automating a synthesizer, which can be controlled through electronic programs and means.

A method of controlling an analog sound on a synthesizer comprising: generating a first sound corresponding to a first wave form, having defined a first knob and switch positions; generating a second sound corresponding to a second wave form, having a second defined knob and switch positions, wherein said first and second wave forms and first and second knob and switch positions are stored in an electronic device, capable of manipulating the position of said knobs and switches electronically; saving, on a controllable device, the first knob and switch positions at a first controlled position, and the second knob and switch positions at a second controlled position; modulating the controllable device between a first and second controlled positions; and interpolating the knob and switch positions between the first and second positions as the controllable device is modulated.

A device providing for remote control of an analog synthesizer comprising a rack device a controller and an analog synthesizer, wherein said rack device is electronically connected to said analog synthesizer and is capable of modify the positions of the analog synthesizer in reaction to a modification of the controller.

The devices or systems of any claim above comprising an oscillator or a keyboard providing input of a signal to create a tone.

A preferred embodiment is directed towards a sound generating analog synthesizer comprising a controller electronically connected to rotate at least one knob, actuate at least one switch, and make at least one patch connection; said knob comprising a drive system, a shaft position sensor, and a potentiometer; wherein said controller rotates at least one knob by generating instructions to said drive system; said at least one switch comprising an electronic connection to said controller to turn on or off said switch upon receiving instructions from said controller; and at least one patch connection, comprising at least one patch switch, wherein said at least one patch switch controls connection between at least one input of said patch and at least one output of said patch; and a control system to interpolate the potentiometer, switch and patch connections between at least two predetermined settings.

In a preferred embodiment, the sound generating analog synthesizer wherein the control system can sense potentiometer positions, switch positions and patch connections whether they are set manually or automatically.

In a preferred embodiment, the sound generating analog synthesizer wherein the state of the switches, knobs and patch connections is made visible to the operator.

In a preferred embodiment, the sound generating analog synthesizer wherein the control system can allow the user to store all of the potentiometer, switch and patch connection settings required to create a particular sound in electronic memory so the analog synthesizer can be returned to previous state, and wherein the control system can interpolate each of the positions of potentiometer, switch and patch connections between 0 and 100%.

In a preferred embodiment, the sound generating analog synthesizer wherein the control system can restore a previous state by setting the potentiometer, switch and patch connections without user assistance using electromechanical and electrical devices.

In a preferred embodiment, the sound generating analog synthesizer wherein the control system can automatically set the knob positions, switch states and patch connections to any setting along the interpolated path between the predetermined settings.

In a preferred embodiment, the sound generating analog synthesizer wherein the control system provides the capability to change the patch connections by proportionally varying the connections between fully-on and fully-off.

In a preferred embodiment, the sound generating analog synthesizer wherein the control system can store and save to memory the settings associated with a particular sound allows the recorded states to be used to define the "sound space" that the user can move through using the input device.

In a preferred embodiment, the sound generating analog synthesizer wherein the control system can be integral to the construction of the analog synthesizer, or it can be retrofit onto an existing analog synthesizer.

In a preferred embodiment, the sound generating analog synthesizer wherein the system can be implemented as a modular synthesizer or semi-modular synthesizer.

In a preferred embodiment, the sound generating analog synthesizer wherein the analog synthesizer can recall the potentiometer, switch and patch connection settings to recreate a stored sound at two or more settings on said control system, and modulate the knob, patch, and switch connections from between 0% of a first setting to 100% of said first setting, to 0% for said second setting to 100% for said second setting. In a preferred embodiment, the sound generating analog synthesizer, wherein the controller can store a set of data corresponding to a patch, switch, and potentiometer amounts, including their relative connectivity between 0 and 100% to save a third setting.

In a preferred embodiment, the sound generating analog synthesizer, comprising an oscillator, keyboard or other signal generating device providing input to create a tone.

In a preferred embodiment, a method of controlling an analog sound on a synthesizer comprising: generating a first sound corresponding to a first wave form, having defined a first knob and switch positions; generating a second sound corresponding to a second wave form, having a second defined knob and switch positions, wherein said first and second wave forms and first and second knob and switch positions are stored in an electronic device, capable of manipulating the position of said knobs and switches electronically; saving, on a controllable device, the first knob and switch positions at a first controlled position, and the second knob and switch positions at a second controlled position; modulating the controllable device between the first and second controlled positions; and interpolating the knob and switch positions between the first and second positions as the controllable device is modulated.

The method of controlling an analog sound, wherein the interpolating provides for a variation between 0% and 100% between the first wave form and the second wave form.

The method of controlling an analog sound, comprising at least three saved wave forms.

The method of controlling an analog sound, wherein the interpolation between the at least three save wave forms allows for between 0% and 100% of each wave form at any given time.

The method of controlling an analog sound, comprising at least four saved wave forms.

The method of controlling an analog sound, utilizing a joystick as the controllable device, wherein the first wave and second wave are plotted at different points on the X, Y coordinate plan along the joysticks operational movement.

The method of controlling an analog sound, utilizing a joystick as the controllable device, wherein the at least four saved wave forms are positioned at different positions on the X, Y coordinate plan along the joysticks operational movement.

DETAILED DESCRIPTION OF THE EMBODIMENTS

Analog synthesizers comprise a plurality of knobs, switches, and patches. These are modified manually in the prior art, and now described herein is the ability to automate the movement between one or more saved settings by using an electronically modified analog synthesizer, and to use a device to modulate from a first wave form to a second (or more), allowing for proportionate control or activation of, in-particular, switches and patches between 0 and 100%.

The analog device must utilize electronic components that include potentiometer positions, switch states and the state of the patch jack connections (including each connection's gain) for a particular sound generated by the analog synthesizer is referred to as a "patch". There is a unique sound associated with any one patch and these sounds can be saved and then modulated by the embodiments of this disclosure.

Figure 1:
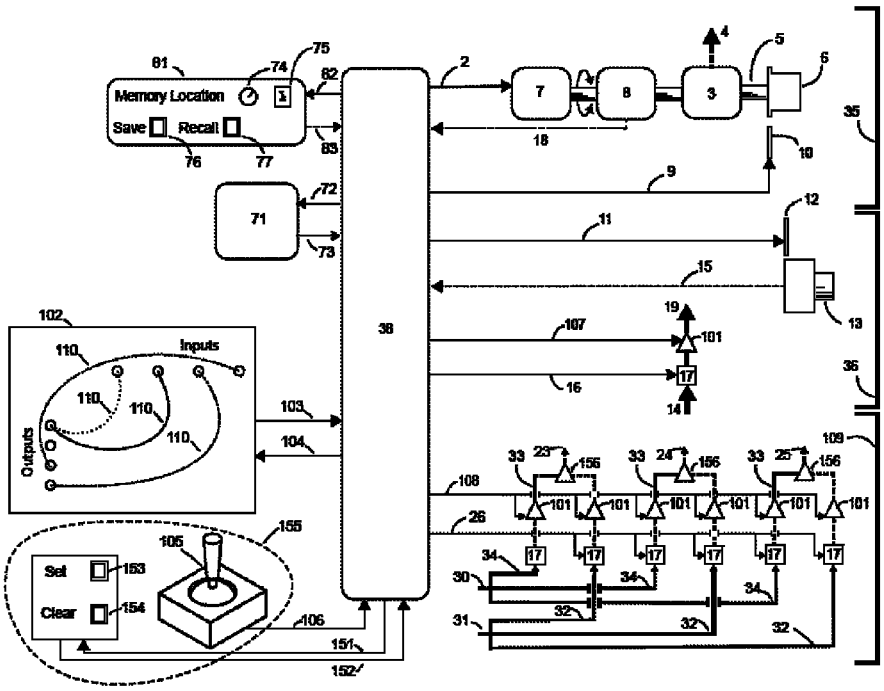
FIG. 1 shows the general arrangement of analog synthesizer controller with save, recall and patch connection morphing.

FIG. 1 provides and overview of how the synthesizer controller 38 that can be implemented as hardware and/or software to control an analog synthesizer while preserving the analog audio signal path. The potentiometer control 35 depicts how the controller 38 controls the position of a potentiometer 3. As depicted in FIG. 1, the analog synthesizer comprises a rotary potentiometer, however, the invention and description is applicable to linear potentiometers as well. The controller 38 senses the shaft 5 position using the signal 18 sent from a potentiometer position sensor 8. Based on the specified desired setting for the potentiometer 3 that is provided to the controller, the controller determines the motion of the potentiometer shaft 5 to move the potentiometer to the desired position and generates a control signal 2 that is delivered to the potentiometer drive system 7. As the potentiometer position signal 18 the controller will update the potentiometer drive control signal 2 using a closed-loop control methodology until the position of the potentiometer 3 matches the desired position that is delivered to the controller as part of the controller input information 103, 106, or 152.

As the potentiometer 3 position is changed, the signal delivered to the analog synthesizer 4 will change as well, but the signal 4 is not in electrical communication with the synthesizer controller 38. Therefore the signal 4 follows an entirely analog path as if it were a traditional analog synthesizer operated entirely manually As in a manually operated analog synthesizer, the knob 6 is directly connected with the potentiometer shaft 5. As the potentiometer 3 moves, the knob 6 will also move. Therefore, as the synthesizer controller 38 adjusts the position of the potentiometer 3 via the drive system 7, the user can visually see the change in position of the potentiometer 3 by visually observing the knob 6.

The synthesizer controller 38 also outputs a potentiometer display control signal 9 which is sent to an electronically controllable display 10. The display 10 provides the user information about the current potentiometer 3 position and saved positions. The display 10 can be any number of display devices, several of which are depicted in more detail in FIG. 2. Those of skill in the art will recognize the suitable display systems available to indicate position and other information that would be useable in these embodiments.

The potentiometer control 35 is implemented such that when operating in fully automatic mode the display 10 can be used to show the current potentiometer 3 position and the desired potentiometer position that is provided to controller 38. The user can use the display to see how close the knob 6, and thus potentiometer 3, are to their target position. One use of this information by the user is to estimate the time it will take the potentiometer 3 to arrive at the desired position.

When the synthesizer controller is operating in fully automatic mode and the potentiometer 3 has achieved the desired position as specified to the controller the drive system 7 can operate such that position of the potentiometer 3 is immediately returned to the desired position. If the user perturbs the position of the knob 6, and thus the position of the potentiometer 3, after the drive system has positioned it at the desired position as specified in the controller input information 103, 106, or 152, the drive system will allow the user the override the drive system. However, immediately after the user releases the knob 6, the drive system 7 will return the potentiometer 3 and knob 6 to the desired position as specified to the control.

The other mode of potentiometer control 35 is manual mode. In this mode the synthesizer controller disengages the drive system 7 such that the user can position the knob 6, and thus the potentiometer 3, manually in the same manner as when operating a manual analog synthesizer. The display 10 only presents the current position of the potentiometer and does not display a desired position as in the other modes. This manual mode duplicates the way a user interacts with a traditional manually operated analog synthesizer.

The switch control 36 illustrates how the synthesizer controller 38 electronically changes the state of a switch. Like the potentiometer, the switch control 36 also operates in manual mode or fully automatic mode. In this embodiment, manual mode is accomplished by the user manually setting the state of the switch by depressing the momentary switch 13. The electrical signal from the momentary switch 15 is used by the synthesizer controller 38 to identify a change the state of the electronically controlled switch 17 is needed and to send a control signal 16 to the switch to execute that change. When closed, the switch 17 completes the circuit between analog synthesizer signals 14 and 19.

When operated in manual mode, the electronically controlled (via connection 11) switch display 12 reflects the current state of the switch, 17.

In the fully automatic mode the synthesizer controller 38 uses the switch control signal 16 to control the state of the electronic switch 17 in order to match the desired state that is part of the controller input information. In this mode the switch display 12 reflects the current and desired state and can show the user when they are equivalent.

Alternatively, the potentiometer control 35 mode is a guided mode. In this mode the synthesizer controller disengages the drive system 7 such that the user can position the knob 6, and thus the potentiometer 3, manually in the same manner as when operating a manual analog synthesizer. In guided mode, the display 10 is used to guide the user to set the potentiometer 3 position to a desired position as specified in the controller input information 103, 106, or 152. For example, a display would indicate current position of the knob 6 and a desired position. Arrows could indicate this, for example on an LCD display, or colored lights, flashing lights, or other visual cues to help the user locate the desired position.

The electronically controlled amplifier 101 that is included in the switch control 36 allows the controller 38 to adjust the state of the switch beyond a binary on or off state. Here the controller 38 can use an electronic signal 107 to adjust the gain of the amplifier 101 so the connection between the signal 14 from the analog amplifier and the return signal to the analog amplifier 19 can be adjusted to any value between 0% (off) and 100% (on).

In this embodiment the switch is single pole single throw type that connects or disconnects the incoming analog synthesizer electrical signal 14 and the outgoing analog synthesizer electrical signal 19. However, the switch control can be implemented with, but not limited to, single throw double pole switches although it is not pictured. In this and more complicated embodiments, the display 12 can be used to inform the user of the state of the switch. Additionally, the momentary switch 13 can be replaced with several momentary switches, a knob or other input device that allows the user to make a selection from more than 2 choices.

The automatic patch morphing control 109 illustrates how the controller 38 can automatically make patch jack connections. The figure shows that there are output patch jacks 30, 31 and input patch jacks 23, 24, 25. Outgoing signals generated by the analog synthesizer are connected to the output patch jacks. In the figure, the first output of synthesizer module one is connected to output patch jack 30. The first output of synthesizer module two is connected to output patch jack 31. Signals that are received by the synthesizer are connected to input patch jacks 23, 24, 25.

In fully automatic mode, the controller 38 sends a command to the electronically controlled switches 17 that are part of the automatic patch connection morphing control 109. The command is delivered to the switches 17 by the switch control signal 26. Each switch 17 can be controlled individually and independently of the others. The switches 17 in the automatic patch control are connected to the analog synthesizer output patch jacks 30, 31 by means of electronic connections 32 or 34. The Connections 32 enable the signal from output patch jack 30 or 31 to reach any of the input patch jacks 23, 24, 25.

Connections 33 connect all of the switches 17 in the automatic patch control to the input patch jacks 23, 24, 25. The switches in the automatic patch control 17 are controlled by the controller 38 such that an analog synthesizer signal output from one of the output patch jacks 30, 31 will only be sent to one of the input patch jacks 23, 24, 25 at a time.

The automatic patch morphing control 109 includes electronically controllable amplifiers 101 which receive a control signal 108 from the controller 38. The amplifiers allow the controller to set the patch connection between an input and output between 0% (unconnected) and 100% (connected). Because any one input port can be receiving signals from more than one output port, an adding amplifier 156 is used to add the signals together into a single signal.

In manual mode, the user uses an interface 102 to indicate which connections are to be made and at what attenuation (0%-100%). However, this input is provided to the controller 38 and controller implements the desired connections using the same procedure as described in fully automatic mode.

The invention is not limited to 5 patch jack connectors. The automatic patch morphing control 109 can be extended to any number of input and output patch jacks.

The patch connections and their gains are input by the user through an electronic interface 102. The use can, but is not limited to, inputting information through a touch screen electronic interface, keyboard or buttons. Input and outputs 103 and 104 from the electronic interface 102, communication with the controller 38 to modulate the various components being controlled. The embodiment pictured is a touch screen interface where the user can specify the connections 110 between input patch jacks and output patch jacks. The interface can also display information about the gain. Here the connections 110 are displayed with different styles of dashed line to suggest difference in gains.

Also shown in FIG. 1 is a patch morphing interface 155. The interface includes a manually manipulated input device such as a joystick 105. One embodiment of this input device is a joystick 105, as pictured, but it is not limited to this embodiment. The interface allows the user to create a "map" of saved patches that can be accessed through the patch morphing interface. The user can select from any number of saved patches creating virtual sound space. The input device 105 can be used to communicate 106 with the controller 38 such that the controller 38 continuously updates the potentiometer positions, switch states and patch connections with gain as the patch morphing interface 155 is adjusted.

The user sets a patch to a specific input device 105 position by using a set input 153. Whatever position the input device is in when set 153 is selected, the currently selected memory location patch 75 will be associated with that position of the input device 105. The user also has the ability to clear patches from specific input device positions or clear all mappings of saved patches to input device positions with the user input 154. These user choices and feedback as to how the controller 38 responds to the requests are communicated to the controller via 151 and back to the interface via 152.

When the patch morphing interface 155 indicates a saved patch setting, the controller 38 will set the potentiometer positions, switch states with gain and patch connections with gain to the saved patch setting. When the patch morphing interface 155 is used to indicate a patch that is not any one of the saved patch settings, the controller 38 "interpolates" between the saved patches to create new patches and therefore a sound different than any of the saved patches stored in memory 71. The controller 38 sends 72 and receives 73 information form memory, as appropriate.

The electronic interface 102 can display current patch connections as well as desired patch connections. The electronic interface 102 is not limited to displaying information about the patch connections and can be used to compliment or substitute for the potentiometer display 10 and the switch display 12. The interface 102 can also be used to present information about the patch morphing interface 155 which can include, but is not limited to, a graphical representation of the requested patch in relationship to the saved patches that represent the sound space.

Figure 2:
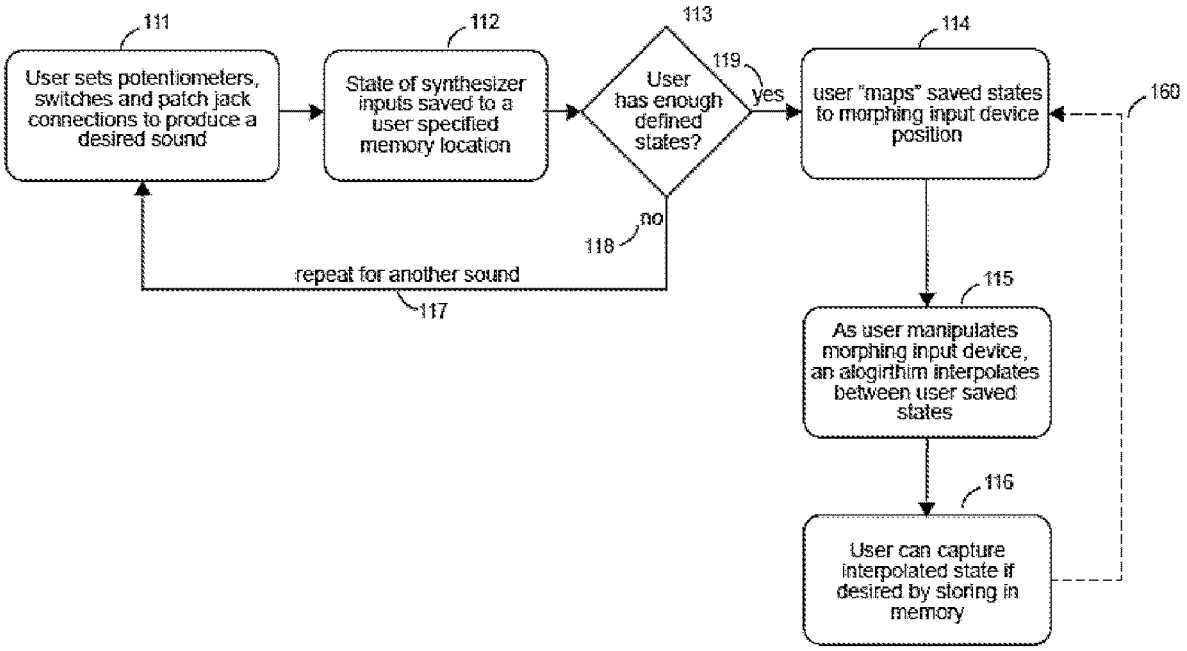
FIG. 2 shows a flow chart of the operation of a patch morphing analog synthesizer control system.

FIG. 2 provides a flow chart of the patch morphing process. Initially the user uses any means to set a patch. That is, set the potentiometer positions, switch states with gains and patch connections with gains 111. This can be accomplished, but is not limited to, manually adjusting the potentiometer knobs 5, the momentary switches 15 and using the patch connection interface 102 to specify specific patch connections. The patch can also be set by using the patch morphing interface 155.

The user then saves the state of the synthesizer, also known as a patch, to a user specified memory location 112. The user can repeat the process 113, 118, 117 for as many patches as can be stored in available memory. Once the user has saved the preferred number of patches 119 to memory 71, the patch morphing interface 155 is used to "map" the saved patches to interface coordinate system 114. To map a saved patch to the joystick coordinate system, the first selects a saved patch through the basic memory selection interface 81 using the selection input 74. The controller 38 sends 82 and receives 83 information from the basic memory selection interface 81 to save 76 or recall 77 positions. The user then manipulates the patch morphing user input 105 to a position of their choice. Using the patch morphing set input 153, the use can "map" the current position of the patch morphing input device 105 to the saved patch such that whenever the user input device 105 is in the same position, the patch set to that position will be set by the controller 38. Therefore, whenever the input device 105 is in that same position, the analog synthesizer will produce the same desired sound.

Once all of the user saved patches have been mapped to input device 105 positions, the controller 38 will respond immediately to any changes in a change in input device 105 position such that when the user selects a position that is mapped to a saved patch, the corresponding patch settings (potentiometer positions, switch states and gains, as well as patch connections and gains) will be implemented by the controller 38. When the input device 105 is not in a position directly mapped to a saved patch, the controller will determine patch settings that best represent an interpolation between the known settings 114. This interpolation 115 will be performed for each individual control (i.e. potentiometer, switch and patch connection). Therefore, as the user manipulates the input device 105 the sound generated by the analog synthesizer will continuously change. The user can capture and save interpolated states 116, simply by generating that interpolated state and saving the various positions of the potentiometer, switch and patch connections.

The user can choose to save any of the interpolated patches to memory by using the save input 76. These saved interpolated patches can be subsequently mapped to the user input position 160, thus updated the mapped sound space.

Figure 3:
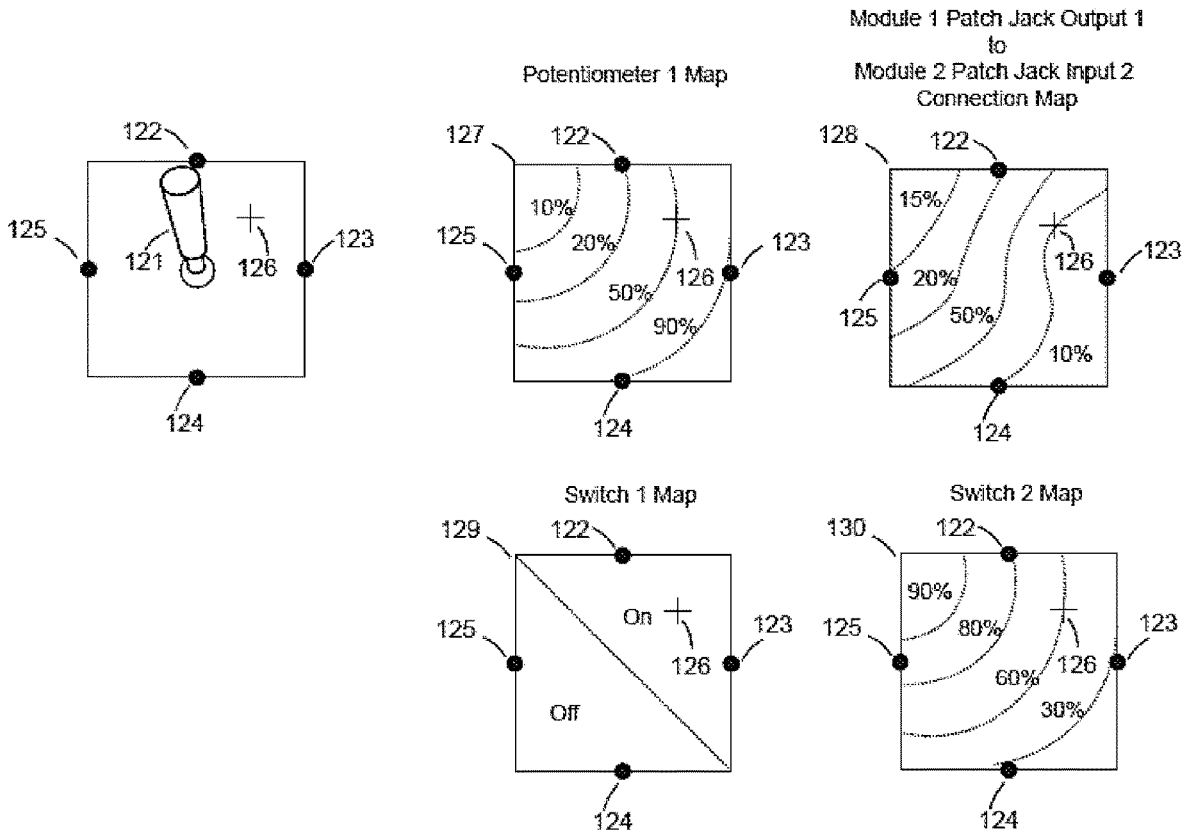
FIG. 3 depicts an embodiment of a patch morphing user interface and method for patch interpolation.

FIG. 3 provides one embodiment of the mapping of saved patches to the user input device 105. Here a two dimensional joystick 121 having movement in the X and Y coordinate directions, is the embodiment of the input device. The user has specified four input device locations 122, 123, 124, 125 where they have mapped a saved patch. If the joystick 121 is positioned at location 126, the controller 38 must interpolate to generate the patch settings as location 126 is not coincident with any of the saved patch locations 122, 123, 124, 125.

FIG. 3 displays the mapped parameter space for a potentiometer 127. Here the potentiometer position is represented as a percentage between 0% and 100% of its full travel. The controller uses a mathematical algorithm to smoothly interpolate between the four known potentiometer positions and joystick positions 122, 123, 124, or 125. The contour lines (shown for 10%, 20%, 50% and 90%) represent the result of that interpolation and allow the controller to establish a potentiometer 3 position for any joystick 121 position. The joystick position 126 would then correspond to a potentiometer position of 50%

A similar process is illustrated by the patch connection map 128. Here the joystick positions 122, 123, 124, 125 have been mapped to the state of a connection between Module 1 Patch Jack Output 1 and Module 2 Patch Jack Input 2. Here 0% represents no connection and 100% represents a connection with no attenuation. The joystick 121 position 126 would result in a 10% of a full connection between Module 1 Patch Jack Output 1 and Module 2 Patch Jack Input 2.

Similarly, the switch 1 map 129, displays a binary map for a switch that is set ON or OFF. In this case the joystick 121 position 126 would correspond to an ON state.

The switch 2 map 130 represents a switch that employs a controller amplifier 101 such that the switch can be set between 0% (OFF) and 100% (ON). Here the joystick 121 position 126 corresponds to a 60% switch setting.

Although this embodiment is described with an input device that has 2 axis, a device with any number of axis will operate similarly.

A user will recognize that any number of mapped sounds can be provided at once, and that the ability to morph between a first, second, third, fourth, etc. sound to create new and unique sounds is provided by these embodiments. Indeed, a user can map any number of sounds and then explore new sounds via morphing between known sounds. As indicated, at any time, the exact parameters can be saved with the click of a button and then that sound, as found between known sounds can be used later. This provides a new and unique way to explore variations to known sounds to create new music.

One embodiment of the synthesizer patch morphing is as a retro-fit to an existing analog synthesizer. In this embodiment, the patch connections can be accessed through standard patch cables with compatible connectors. These cables can electrically connect the existing analog synthesizers to an automatic patch morphing control 109.

Figure 4:
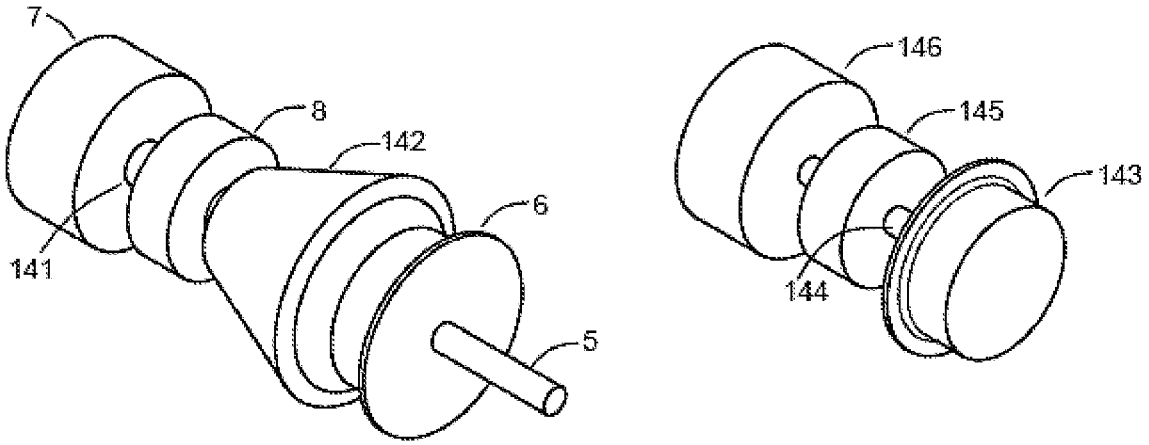
FIG. 4 depicts an embodiment of a retro fit.

One embodiment of a retro-fit potentiometer control is shown in FIG. 4. Here an existing knob 6 and shaft 5 can be actuated by a drive system 7 that is attached to the knob 6 by means of a shaft 141 and a compliant coupler 142. Here the coupler attaches to the knob 6. In another embodiment, not pictured, the coupler 142 can also be designed such that it will attach directly to the shaft 5 after the knob 6 is removed.

In this embodiment a "mirror" knob would be positioned elsewhere and would be the means by which the user would interact with the knob. Here the mirror knob 143 is connected to a shaft 144 that is not shared with the knob 6. The shaft 144 is connected to a shaft position sensor 145 and a drive system 146.

When the user would want to manually manipulate the knob 6 in a manual mode they would instead rotate knob 143 and the change in position would be detected by the sensor 145 which would relay the information to the controller 38 and in turn the controller 38 would send a signal to the potentiometer drive system 7 and thus the knob 6 would turn. The position sensor 8 would ensure the knob 6 was in the desired position.

If the controller 38 is operating in a fully automatic mode, the controller 38 will send a control signal to both drives 7, 146 so the position of knob 6 will be represented by the position of knob 143 for the user.

A knob display 10 is not pictured, but would be positioned next to knob 143 in this embodiment to provide the user feedback on their inputs.

In certain embodiments, a matrix of amplifiers controlled by a Raspberry PI microcontroller (or other suitable controller) to proportionally control the patch connections. To achieve proportional control, and to allow for a combination of automatic and manual adjustment, in certain of the embodiments, control is provided by a stepper motor controlling radial potentiometers with a separate potentiometer for position sensing. Other motors including those having a clutch or other variable rates can be used to allow for the modification between 0 and 100% for each of the potentiometer, switch connection, and patch connections.

Those of skill in the art will recognize that numerous devices can be utilized to generate the input from an oscillator that is sufficient to generate the modified sounds utilized herein. Indeed, preferred embodiments utilize an oscillator, keyboard or other signal generating device providing input to create a tone.

Suitable amplifiers and generates can be further added, so that those who seek to play music with these devices can generate sufficient sounds from the analog synthesizer device described herein.

What is claimed is:

1. A sound generating analog synthesizer comprising a controller electronically connected to rotate at least one knob, actuate at least one switch, and make at least one patch connection; said knob comprising a drive system, a shaft position sensor, and a potentiometer; wherein said controller rotates at least one knob by generating instructions to said drive system; said at least one switch comprising an electronic connection to said controller to turn on or off said switch upon receiving instructions from said controller defining a switch position; and at least one patch connection, comprising at least one patch switch, wherein said at least one patch switch controls a connection between at least one input of said patch and at least one output of said patch; and a control system to interpolate the potentiometer, the switch position and the at least one patch connection between at least two predetermined settings.

2. The sound generating analog synthesizer of claim 1, wherein the control system can sense the potentiometer, switch positions and patch connections whether they are set manually or automatically.

3. The sound generating analog synthesizer of claim 1, wherein a status of the switches, knobs and patch connections is made visible on a display.

4. The sound generating analog synthesizer of claim 1, wherein the control system stores all of a connection setting for each of the potentiometer, switch positions and patch connections required to create a particular sound in electronic memory so the analog synthesizer can be returned to previous state, and wherein the control system can interpolate each of the positions of the potentiometer, switch positions and patch connections between 0 and 100%.

5. The sound generating analog synthesizer of claim 1, wherein the control system can restore a previous state by setting the potentiometer, switch positions, and patch connections without user assistance using electromechanical and electrical devices.

6. The sound generating analog synthesizer of claim 1, wherein the control system can automatically set knob positions, switch states and patch connections to any setting along an interpolated path between the predetermined settings.

7. The sound generating analog synthesizer of claim 1, wherein the control system changes the at least one patch connection by proportionally varying the connections between fully-on and fully-off.

8. The sound generating analog synthesizer of claim 1, wherein the control system can store and save to memory the predetermined settings associated with a particular sound, and wherein a recorded state to be used to define a "sound space" may be controlled through using an input device.

9. The sound generating analog synthesizer of claim 1, wherein the control system can be integral to the construction of the analog synthesizer, or it can be retrofitted onto an existing analog synthesizer.

10. The sound generating analog synthesizer of claim 1, wherein the control system can be implemented as a modular synthesizer or semi-modular synthesizer.

11. The sound generating analog synthesizer of claim 1, wherein the analog synthesizer can recall the potentiometer, switch position and patch connection settings to re-create a stored sound at two or more settings on said control system, and modulate the knob, change the patch connection, and change the switch position from between 0% of a first setting to 100% of said first setting, to 0% for said second setting to 100% for said second setting.

12. The sound generating analog synthesizer of claim 11, wherein the controller can store a set of data corresponding to patch, switch, and potentiometer amounts, including their relative connectivity between 0 and 100% to save a third setting.

13. The sound generating analog synthesizer of claim 1, comprising an oscillator, keyboard or other signal generating device providing input to create a tone.

14. A method of controlling an analog sound on a synthesizer comprising:

a. generating a first sound corresponding to a first wave form, having defined a first knob and switch positions; generating a second sound corresponding to a second wave form, having a second defined knob and switch positions, wherein said first and second wave forms and first and second knob and switch positions are stored in an electronic device, said electronic device comprising a controller electronically connected to a controllable device, having electrical connection to rotate at least one knob, and actuate at least one switch;

b. saving, on the controllable device, the first knob and switch positions at a first controlled position, and the second knob and switch positions at a second controlled position;

c. modulating the controllable device between the first and second controlled positions; and d. interpolating the knob and switch positions between the first and second knob and switch positions as the controllable device is modulated.

15. The method of claim 14 wherein the interpolating provides for a variation between 0% and 100% between the first wave form and the second wave form.

16. The method of claim 14 comprising at least three saved wave forms.

17. The method of claim 16, wherein the interpolation between the at least three saved wave forms allows for between 0% and 100% of each wave form at any given time.

18. The method of claim 14 comprising at least four saved wave forms.

19. The method of claim 18, utilizing a joystick as the controllable device, wherein the at least four saved wave forms are positioned at different positions on an X, Y coordinate plan along the joystick's operational movement.

20. The method of claim 14 utilizing a joystick as the controllable device, wherein the first wave form and the second wave form are plotted at different points on an X, Y coordinate plan along the joystick's operational movement.

* * * * *